US006920203B2

(12) United States Patent
Short et al.

(10) Patent No.: US 6,920,203 B2
(45) Date of Patent: Jul. 19, 2005

(54) METHOD AND APPARATUS FOR SELECTIVELY ATTENUATING A RADIATION SOURCE

(75) Inventors: Jonathan Short, Clifton Park, NY (US); John Eric Tkaczyk, Delanson, NY (US); Brian David Yanoff, Schenectady, NY (US); Loucas Tsakalakos, Niskayuna, NY (US)

(73) Assignee: General Electric Company, Schenectady, NY (US)

( * ) Notice: Subject to any disclaimer, the term of this patent is extended or adjusted under 35 U.S.C. 154(b) by 265 days.

(21) Appl. No.: 10/308,704

(22) Filed: Dec. 2, 2002

(65) Prior Publication Data

US 2004/0105525 A1 Jun. 3, 2004

(51) Int. Cl.[7] ..... G21K 1/02
(52) U.S. Cl. ..... 378/147; 378/148; 378/158
(58) Field of Search ..... 378/147, 148, 378/150, 151, 156, 157, 158, 98.7

(56) References Cited

U.S. PATENT DOCUMENTS

| | | | | |
|---|---|---|---|---|
| 3,755,672 A | * | 8/1973 | Edholm et al. | 378/158 |
| 4,497,062 A | | 1/1985 | Mistretta et al. | 378/158 |
| 5,081,659 A | | 1/1992 | Dobbins, III | 378/99 |
| 5,107,529 A | * | 4/1992 | Boone | 378/157 |
| 5,559,853 A | | 9/1996 | Linders et al. | 378/159 |
| 5,666,396 A | | 9/1997 | Linders et al. | 378/156 |
| 5,751,786 A | | 5/1998 | Welters et al. | 378/156 |
| 5,768,340 A | | 6/1998 | Geittner et al. | 378/159 |
| 5,778,046 A | | 7/1998 | Molloi et al. | 378/159 |
| 5,878,111 A | | 3/1999 | Schulz | 378/158 |
| 5,881,127 A | | 3/1999 | Molloi et al. | 378/159 |
| 5,923,724 A | | 7/1999 | Soukal | 378/156 |
| 5,966,426 A | | 10/1999 | Marra et al. | 378/159 |
| 6,094,474 A | | 7/2000 | Vezina | 378/156 |
| 6,118,855 A | | 9/2000 | Welters et al. | 378/158 |
| 6,188,749 B1 | | 2/2001 | Schiller et al. | 378/158 |
| 6,201,852 B1 | * | 3/2001 | Goddu et al. | 378/159 |
| 6,221,654 B1 | | 4/2001 | Quake et al. | 435/287.3 |
| 6,269,147 B1 | | 7/2001 | Powell | 378/158 |
| 6,301,055 B1 | | 10/2001 | Legrand et al. | 359/642 |
| 6,370,228 B1 | * | 4/2002 | Mockler et al. | 378/158 |
| 6,408,878 B2 | | 6/2002 | Unger et al. | 137/597 |
| 2001/0029983 A1 | | 10/2001 | Unger et al. | 137/597 |
| 2001/0033796 A1 | | 10/2001 | Unger et al. | 417/53 |
| 2001/0054778 A1 | | 12/2001 | Unger et al. | 264/239 |
| 2002/0005354 A1 | | 1/2002 | Spencer et al. | 204/450 |

FOREIGN PATENT DOCUMENTS

| | | | |
|---|---|---|---|
| WO | WO 96/00967 | 1/1996 | G21K/3/00 |
| WO | WO 96/13040 | 5/1996 | G21K/3/00 |
| WO | WO 97/03450 A2 A3 | 1/1997 | G21K/3/00 |
| WO | WO 98/21729 | 5/1998 | G21K/3/00 |

* cited by examiner

*Primary Examiner*—Craig E. Church
*Assistant Examiner*—Irakli Kiknadze
(74) *Attorney, Agent, or Firm*—Fletcher Yoder

(57) ABSTRACT

A technique for selectively attenuating a radiation exposure in which a configurable collimator is employed between the radiation source and the radiation target. The configurable collimator typically comprises an array of independently addressable elements each of which has at least a high and a low attenuation state, though intermediate states may also be accommodated. The elements of the array may be selectively addressed to determine their state and to determine the attenuation profile of the collimator. One embodiment of the technique employs an array of microactuated attenuating louvers which may be selectively actuated to determine their radiation transmittance. A second embodiment of the technique employs a suspension of attenuating nematic colloids which may be ordered by the application of an electric or magnetic field. The ordered state of the nematic colloids within an element determine the radiation transmittance of that element. A third embodiment of the technique employs microfluidics to fill an array of fluid chambers with an attenuating fluid. The level of filling within each chamber determines the attenuation produced by that array element.

32 Claims, 7 Drawing Sheets

METHOD AND APPARATUS FOR SELECTIVELY ATTENUATING A RADIATION SOURCE

BACKGROUND OF THE INVENTION

The present invention relates generally to medical imaging, and more particularly to selectively attenuating a stream of radiation to which a patient is exposed. Specifically, the present technique relates the use of a configurable mask to optimize the X-ray flux incident on a patient such that the best image quality per unit dose of radiation is achieved for the target area.

In X-ray imaging systems, radiation from a source is directed toward a subject, typically a patient in a medical diagnostic application. A portion of the radiation passes through the patient and impacts a detector. In digital X-ray imaging, the surface of the detector converts the radiation to light photons which are sensed. The detector is divided into a matrix of discrete picture elements or pixels, and encodes output signals based upon the quantity or intensity of the radiation impacting each pixel region. Because the radiation intensity is altered as the radiation passes through the patient, the images reconstructed based upon the output signals provide a projection of the patient's tissues similar to those available through conventional photographic film techniques.

Digital X-ray imaging systems are particularly useful due to their ability to collect digital data which can be reconstructed into the images required by radiologists and diagnosing physicians, and stored digitally or archived until needed. In conventional film-based radiography techniques, actual films are prepared, exposed, developed and stored for use by the radiologist. While the films provide an excellent diagnostic tool, particularly due to their ability to capture significant anatomical detail, they are inherently difficult to transmit between locations, such as from an imaging facility or department to various physician locations. The digital data produced by direct digital X-ray systems, on the other hand, can be processed and enhanced, stored, transmitted via networks, and used to reconstruct images which can be displayed on monitors and other soft copy displays at any desired location. Similar advantages are offered by digitizing systems which convert conventional radiographic images from film to digital data.

One of the issues which arises in X-ray imaging, as well as other medical procedures in which a patient is selectively exposed to radiation, is delivering the appropriate amount of radiation to the target tissue needed to produce the desired image while minimizing the radiation dose to the target tissue, but also non-target tissues and even non-patients, such as medical staff. In particular, non-target tissue near the target tissue may be unnecessarily exposed to the radiation stream. Likewise, the target tissue need only be exposed to the minimum dose of radiation necessary to produce images of the desired quality. Typically, this quality can be described in terms of a signal-to-noise ratio which increases as the square root of the X-ray dose, i.e., doubling the signal-to-noise ratio requires quadrupling the X-ray dose.

Some dose reduction may be accomplished by optimizing the energy spectrum produced by the X-ray tube. This is done by adjusting the accelerating voltage applied to the tube or by introducing a spectral filter between the X-ray tube and the patient. Both of these methods allow the spectral profile of the radiation reaching the patient to be modified.

More generally, X-ray exposure can be regulated by exposure management or by using information extracted from previous exposures. In other words, the patient is protected by limiting the number of exposure events to which he or she is exposed. Alternatively, the field-of-view, or area of irradiation, may be collimated to a reduced area which still allows imaging of the target tissue. This collimation, however, is of limited effectiveness as the system operator is typically limited to an assortment of collimators of fixed size and shape from which the operator chooses the "best fit". Only rarely, will a prepared collimator of precisely the right dimensions be available.

In addition, the detector itself is typically sensitive to high radiation flux levels and may be damaged or experience degraded performance at such levels. In particular, the detector may become saturated at flux levels outside the desired dynamic range, degrading imaging system performance. Such high flux levels may result on the detector when the tissue thickness or X-ray attenuation is small or in areas where the radiation from the X-ray source is not attenuated before reaching the detector (e.g. peripheral areas). Collimators or attenuating filters, typically either plates or fluid filled bags, may be employed between the X-ray tube and the detector to reduce saturation or other flux-related detector problems. The collimators or filters are typically of fixed dimension and shape and are manually adjusted and positioned with varying degrees of accuracy. In addition, the fixed shapes of these devices do not generally match the complex and unique shapes of patient anatomy. There is a need, therefore, for improved spatial X-ray filtering, attenuating and collimating approaches that can provide more flexible and precise control of radiation delivery to areas of a patient or other target.

BRIEF DESCRIPTION OF THE INVENTION

The present invention provides a technique for selectively attenuating a radiation stream by employing a configurable "collimator." The collimator typically comprises an array of addressable elements which may possess varying attenuation properties, depending upon the element configuration. The attenuation properties of the elements are set to provide the desired attenuation profile for the radiation stream to which a target is exposed. Various technologies may be employed to construct the addressable elements, including, but not limited to, the use of microactuating louvers, orientable nematic colloid suspensions, and microfluidics employed to regulate the level of an attenuating fluid within array chambers.

In accordance with one aspect of the present technique, a method for selectively attenuating a radiation stream is provided. The method includes the acts of positioning an array of two or more configurable elements between a radiation source and a target configuring the two or more configurable and addressable elements such that each element is set to a desired attenuation level for that element. In addition, the method includes passing a stream of radiation from the source through the array such that the stream is selectively attenuated.

In accordance with another aspect of the present technique, a selective attenuation system which attenuates a radiation stream is provided. The system includes a source of a radiation stream as well as a detector of the radiation stream. In addition, the system includes a configurable collimator positioned between the source and the target, comprising at least one array of independently configurable attenuating elements.

In accordance with a further aspect of the present technique, a selective attenuation system which attenuates a radiation stream is provided. The system includes a source of a radiation stream as well as a detector of the radiation stream. In addition, the system includes a means for selectively attenuating the radiation stream reaching the target.

In accordance with another aspect of the present technique, a method for selectively attenuating an X-ray stream is provided. The method includes the acts of exposing a patient to an initial X-ray exposure from an X-ray source to determine a desired attenuation profile and configuring a collimator positioned between the X-ray source and the patient to produce the desired attenuation profile. The collimator comprises at least one array of configurable and addressable attenuation elements which possess at least a high attenuation state and a low attenuation state. The method also includes the act of exposing the patient to an attenuated X-ray exposure possessing the desired attenuation profile through the configured collimator.

In accordance with a further aspect of the present technique, an X-ray attenuation system is provided. The system includes a source of an X-ray stream and a detector of the X-ray stream. In addition the system includes a collimator positioned between the source and the detector comprising at least one array of configurable attenuation elements which possess at least a high attenuation state and a low attenuation state.

DETAILED DESCRIPTION OF SPECIFIC EMBODIMENTS

Figure 1:
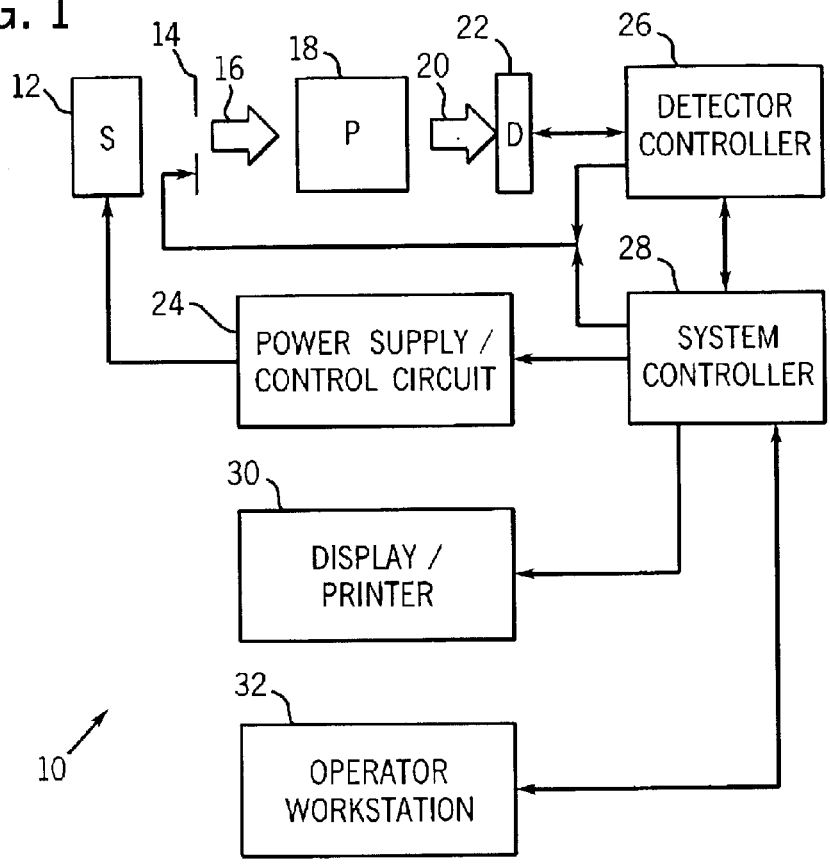
FIG. 1 is a diagrammatical overview of a digital X-ray imaging system in which the present technique is incorporated.

FIG. 1 illustrates diagrammatically an imaging system 10 for acquiring and processing discrete pixel image data. In the illustrated embodiment, system 10 is a digital X-ray system designed both to acquire original image data, and to process the image data for display in accordance with the present technique. Though an X-ray system is described herein, the disclosed technique is equally applicable to attenuating other types of radiation streams in medical imaging and non-imaging contexts. For example, microwave, X-ray, gamma ray and other types of radiation employed in other commercial contexts, such as communications, food preparation and preservation, or scientific analysis, may utilize the techniques described below to provide selective attenuation.

In the embodiment illustrated in FIG. 1, imaging system 10 includes a source of X-ray radiation 12 positioned adjacent to a configurable collimator 14. Configurable collimator 14 selectively attenuates the flux intensity of a stream of radiation 16 which passes through it such that the stream 16 may be shaped to conform to the shape of a target region of a patient 18 or the patient himself and may be of varying flux intensity within the collimated region. In particular, the configurable collimator 14 is comprised of a numerous individually addressable elements such that the elements may be selectively activated to attenuate the stream of radiation 16. Each addressable element is associated with a sub-area of the field of view and has a minimum of two states, high and low transmittance. Other embodiments of the technique however, as discussed below, include addressable elements which can be controlled in a graded manner such that transmittance may be adjusted between the high and low extremes in a continuous manner.

The selectively attenuated stream of radiation 16 passes through a region in which a subject, such as a human patient 18 is positioned. A portion of the radiation 20 passes through or around the subject 18 and impacts a digital X-ray detector, represented generally at reference numeral 22. As described more fully below, detector 22 converts the X-ray photons received on its surface to lower energy photons, and subsequently to electric signals which are acquired and processed to reconstruct an image of the features within the subject. Due to the selective attenuation provided by the configurable collimator 14, the stream of radiation 16 is attenuated such the detector 22 is only impacted by an X-ray flux within a desired dynamic range of the detector 22. In a typical embodiment, the radiation stream 16 is attenuated such that the flux reaching the detector 22 is equalized. In an embodiment in which equalization of the flux reaching the detector 22 is desired, thicker regions of the patient 18 will receive a larger incident flux while the portion of the radiation stream 16 directed toward thinner regions of the patient 18 will receive greater attenuation. Because of this careful control of the dynamic range of the flux, the detector 22 can be constructed to detect a greater dynamic range without fear of inadvertent damage by unintended high fluxes, improving image quality for regions of the body requiring greater dynamic range. In particular, the stream of radiation 16 is attenuated by the configurable collimator 14 to conform to the patient's or target region's shape such that only the portion of radiation 20 passing through the patient 18 impacts the detector 22. This portion 20 is attenuated such that it does not exceed the desired dynamic range of the detector 22. This selective attenuation of the stream 16 helps eliminate or reduce saturation of the detector 22, and thereby increases detector lifetime and improves image quality.

The necessary configuration of the configurable collimator 14 to achieve these results may be determined from previous exposures such as an initial low-dose exposure expressly for the purpose of collimator configuration or a prior diagnostic exposure. This prior exposure or exposures provide information regarding patient positioning and thickness to the detector controller 26 which can then be used to address the configurable collimator 14 in the manner described below. While FIG. 1 depicts the configurable collimator 14 as being deployed alone between the source 12 and the patient 18, a more traditional collimator or various spectral filters may also be present and act in conjunction with the configurable collimator 14. In addition, to the extent that protection of the detector 22 is the goal, the configurable collimator 14 may be enlarged and located between the patient 18 and the detector 22. In such instances, the stream of radiation which is attenuated by the collimator 14 is the pass-through radiation 20, not the initial radiation stream 16.

Source 12 is controlled by a power supply/control circuit 24 which furnishes both power and control signals for examination sequences. Moreover, detector 22 is coupled to a detector controller 26 which commands acquisition of the signals generated in the detector. Detector controller 26 may also execute various signal processing and filtration functions, such as for initial adjustment of the configurable collimator 14, interleaving of digital image data, and so forth. Both power supply/control circuit 24 and detector controller 26 are responsive to signals from a system controller 28. In general, system controller 28 commands operation of the imaging system to execute examination protocols and to process acquired image data. In the present context, system controller 28 also includes signal processing circuitry, typically based upon a general purpose or application-specific digital computer, associated memory circuitry for storing programs and routines executed by the computer, as well as configuration parameters and image data, interface circuits, and so forth.

Typically the system controller 28 will initiate an initial exposure by the source 12 at a low-dose which provides information to the detector controller 26 such as patient position and thickness. The detector controller 26 then, either directly or via the system controller 28, selectively addresses attenuating elements within the configurable collimator 14 to produce an attenuation profile which optimizes X-ray transmission to produce the desired signal-to-noise ratio at the detector 22. Once the configurable collimator is configured a high-dose diagnostic exposure can be initiated by the system controller 28. In addition, the feedback information from such a diagnostic, or high-dosage, exposure may also be used by the detector controller 26 to optimize the attenuation profile of the configurable collimator 14. In this manner, the image quality of the target region is optimized, that is, the information content per unit dose of radiation received by the patient, without subjecting the detector 22 to unnecessary X-ray flux.

In the embodiment illustrated in FIG. 1, system controller 28 is linked to at least one output device, such as a display or printer as indicated at reference numeral 30. The output device may include standard or special purpose computer monitors and associated processing circuitry. One or more operator workstations 32 may be further linked in the system for outputting system parameters, requesting examinations, viewing images, and so forth. In general, displays, printers, workstations, and similar devices supplied within the system may be local to the data acquisition components, or may be remote from these components, such as elsewhere within an institution or hospital, or in an entirely different location, linked to the image acquisition system via one or more configurable networks, such as the Internet, virtual private networks, and so forth.

Figure 2:
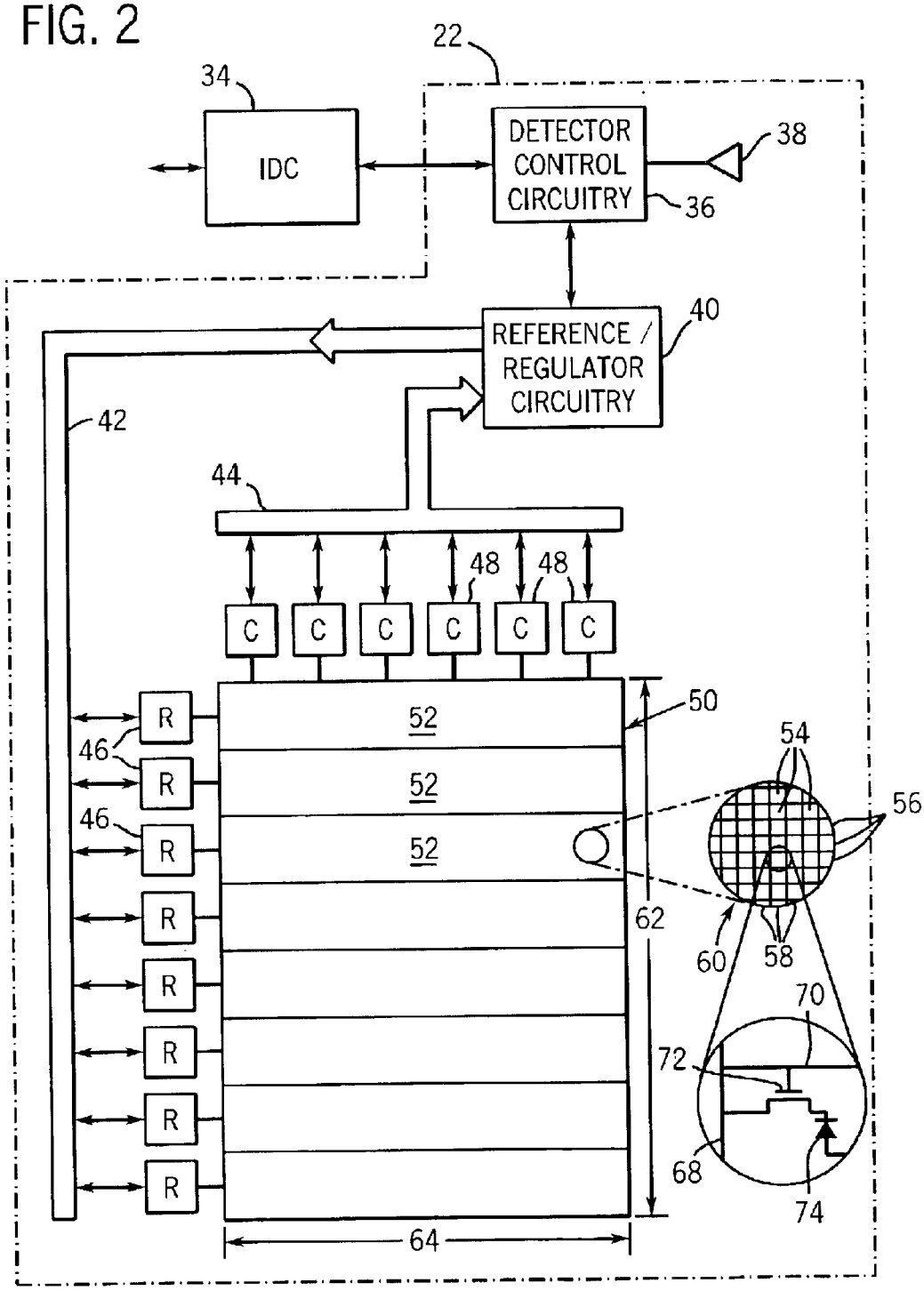
FIG. 2 is a diagrammatical representation of certain of the functional circuitry for producing image data in a detector of the system of FIG. 1 to produce image data for reconstruction.

FIG. 2 is a diagrammatical representation of functional components of digital detector 22. FIG. 2 also represents an imaging detector controller or IDC 34 which will typically be configured within detector controller 26. IDC 34 includes a CPU or digital signal processor, as well as memory circuits for commanding acquisition of sensed signals from the detector. IDC 34 is coupled via two-way fiberoptic conductors to detector control circuitry 36 within detector 22. IDC 34 thereby exchanges command signals for image data within the detector during operation.

Detector control circuitry 36 receives DC power from a power source, represented generally at reference numeral 38. Detector control circuitry 36 is configured to originate timing and control commands for row and column drivers used to transmit signals during data acquisition phases of operation of the system. Circuitry 36 therefore transmits power and control signals to reference/regulator circuitry 40, and receives digital image pixel data from circuitry 40.

In one embodiment illustrated, detector 22 consists of a scintillator that converts X-ray photons received on the detector surface during examinations to lower energy (light) photons. An array of photodetectors then converts the light photons to electrical signals which are representative of the number of photons or the intensity of radiation impacting individual pixel regions of the detector surface. Readout electronics convert the resulting analog signals to digital values that can be processed, stored, and displayed, such as in a display 30 or a workstation 32 following reconstruction of the image. In a present form, the array of photodetectors is formed on a single base of amorphous silicon. The array elements are organized in rows and columns, with each element consisting of a photodiode and a thin film transistor. The cathode of each diode is connected to the source of the transistor, and the anodes of all diodes are connected to a negative bias voltage. The gates of the transistors in each row are connected together and the row electrodes are connected to the scanning electronics. The drains of the transistors in a column are connected together and an electrode of each column is connected to readout electronics.

In the particular embodiment illustrated in FIG. 2, by way of example, a row bus 42 includes a plurality of conductors for enabling readout from various columns of the detector, as well as for disabling rows and applying a charge compensation voltage to selected rows, where desired. A column bus 44 includes additional conductors for commanding readout from the columns while the rows are sequentially enabled. Row bus 42 is coupled to a series of row drivers 46, each of which commands enabling of a series of rows in the detector. Similarly, readout electronics 48 are coupled to column bus 44 for commanding readout of all columns of the detector.

In the illustrated embodiment, row drivers 46 and readout electronics 48 are coupled to a detector panel 50 which may be subdivided into a plurality of sections 52. Each section 52 is coupled to one of the row drivers 46, and includes a number of rows. Similarly, each column driver 48 is coupled to a series of columns. The photodiode and thin film transistor arrangement mentioned above thereby define a series of pixels or discrete picture elements 54 which are arranged in rows 56 and columns 58. The rows and columns define an image matrix 60, having a height 62 and a width 64.

As also illustrated in FIG. 2, each pixel 54 is generally defined at a row and column crossing, at which a column electrode 68 crosses a row electrode 70. As mentioned above, a thin film transistor 72 is provided at each crossing location for each pixel, as is a photodiode 74. As each row is enabled by row drivers 46, signals from each photodiode may be accessed via readout electronics 48, and converted to digital signals for subsequent processing and image reconstruction.

Figure 3:
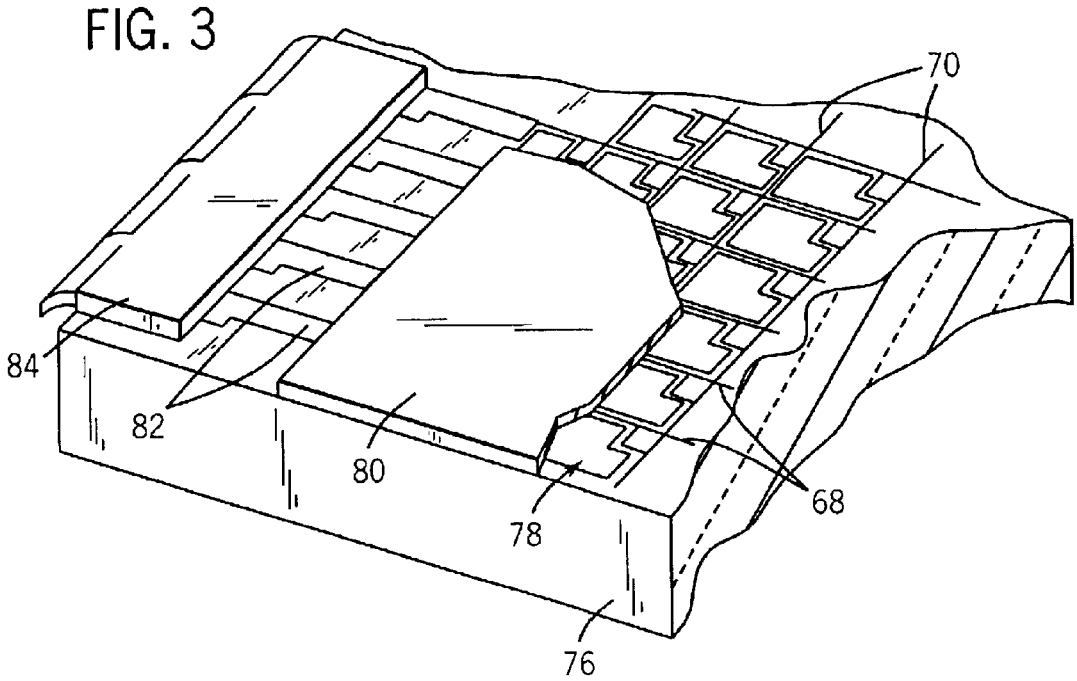
FIG. 3 is a partial sectional view illustrating an exemplary detector structure for producing the image data.

FIG. 3 generally represents an exemplary physical arrangement of the components illustrated diagramatically in FIG. 2. As shown in FIG. 3, the detector may include a glass substrate 76 on which the components described below are disposed. Column electrodes 68 and row electrodes 70 are provided on the substrate, and an amorphous silicon flat panel array 78 is defined, including the thin film transistors and photodiodes described above. A scintillator 80 is provided over the amorphous silicon array for receiving radiation during examination sequences as described above. Contact fingers 82 are formed for communicating signals to and from the column and row electrodes, and contact leads 84 are provided for communicating the signals between the contact fingers and external circuitry.

The detector 22 illustrated diagramatically in FIG. 2 and sectionally in FIG. 3 is sensitive to the radiation flux produced by the source 12 within a certain dynamic range. Radiation fluxes beyond this dynamic range or the unnecessary exposure of the detector 22 to radiation fluxes may damage the detector 22 or may degrade the quality of a captured image. As noted above, one technique for addressing this concern is to selectively attenuate the radiation stream 16 reaching the patient 18 and the detector 22 by selectively addressing and configuring the configurable collimator 14.

Figure 4:
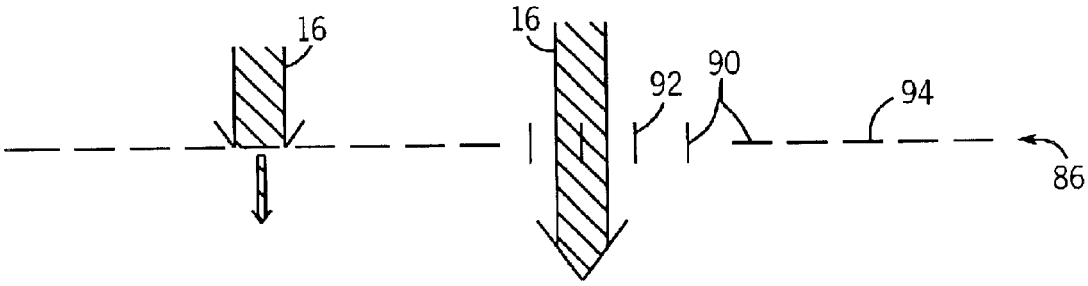
FIG. 4 is a diagrammatical side view of one embodiment of the present technique employing microactuated louvers as elements in an addressable array of collimator elements.
Figure 5:
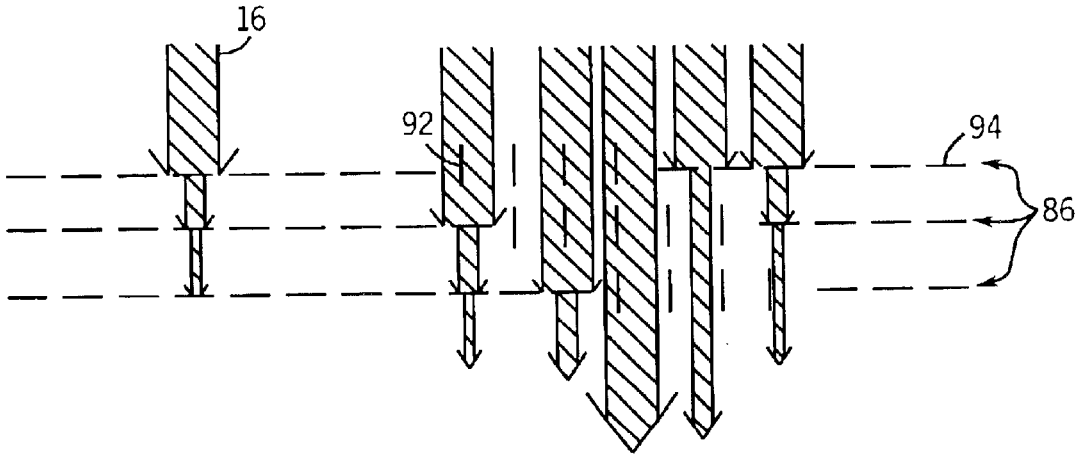
FIG. 5 is a diagrammatical side view of a stack of arrays as depicted in FIG. 4.

One embodiment of the configurable collimator 14 is depicted in FIG. 4. This embodiment encompasses an array 86 of microelectromechanical systems (MEMS) which may be selectively adjusted to determine radiation transmittance. Various MEMS configuration may be implemented, such as either in-plane or out-of-plane configurations in which the MEMS are rotated into open, closed or intermediate positions. An exemplary out-of-plane configuration is depicted in FIG. 4, in which a row of selectively addressable microactuators, here depicted as louvers 90, are shown. A typical array 86 may comprise a 128-by-128 array of elements, louvers 90 in this implementation, though other array sizes are feasible. The relatively small size of the array 86 allows for rapid configuration adjustments so that the collimator may be employed in the imaging system 10 without introducing significant delays. Various means of microactuation may be utilized, including electrostatic, magnetic, magnetostrictive, piezoelectric, or thermal actuation. The means of microactuation may be selected based upon the desired response time, displacement, ease of fabrication/integration, cost, and force, all of which may vary for the different means of microactuation.

Each louver 90 or other form of microactuator may be comprised of a material which is either itself substantially opaque to radiation transmittance or is coated in such a substantially opaque material. For example, to form a louver 90, a silicon core, which is substantially transparent to X-rays, may be coated with a material which is substantially opaque to X-rays, such as lead, tungsten, molybdenum or some combination of these materials. In some applications where energy levels are lower, such as mammography, other attenuating materials may also work. In addition, complementary attenuating materials may also be selected such that the fluorescent radiation from one material is absorbed by another.

A grid of control lines correspond to the array 86 of louvers 90 such that a control signal can be sent to the microactuator associated with a specific louver 90 within the array 86 to activate or deactivate the specific louver 90. An activated louver 92 that is substantially parallel to the stream of radiation 16 allows the stream 16 to pass through the corresponding array location relatively unattenuated. A deactivated louver 94, however, is substantially perpendicular to the stream of radiation 16 and largely blocks or absorbs the stream 16, thereby attenuating the stream 16 passing through the array 86 at that array coordinate location. By activating and deactivating the louvers 90 the attenuation profile of the configurable collimator 14 can be adjusted to produce the desired dose incident upon the patient 18 such that image quality is optimized in view of the desired dose both to the patient 18 and the detector 22. This implementation may be modified such that the default state of the array 86 is radiation transparency, i.e., the unactivated louvers 90 are substantially parallel to the radiation stream 16. In this implementation, activation of a louver 90 instead closes the louver 90, that is, orients it substantially perpendicular to the radiation stream 16. In general, the configurable MEMS actuators possess at least an actuated and an unactuated state, which differ in their radiation transmittance.

While the louvers 90 have been discussed as possessing two states, activated and deactivated, other intermediate louver states, i.e. states at angles intermediate to 0° and 90° relative to the radiation stream 16, may exist which produce intermediate levels of attenuation of the radiation stream 16. Likewise, intermediate levels of attenuation may be achieved by utilizing a stack of arrays 86. In this embodiment, the deactivated louvers 94 of each array 86 differ in the amount of attenuation they produce, thereby allowing finer gradation in the amount of attenuation generated. In such an embodiment, a stack of deactivated louvers 94 may create nearly complete attenuation of the radiation stream 16 while a mixed stack of deactivated 94 and activated 92 louvers creates an intermediate degree of attenuation. While an out-of-plane MEMS implementation consisting of louvers 90 has been discussed for simplicity and ease of visualization, other configuration, such as in-plane rotational implementations are also possible. In such implementations, the microactuator may be constructed as discussed for the louver 90 but might rotate within the plane of the array 86 to open or close a radiation transparent opening.

Figure 6:
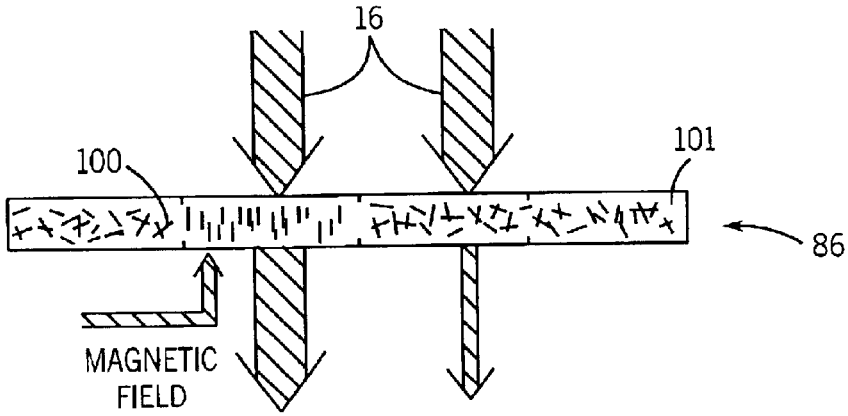
FIG. 6 is a diagrammatical side view of one embodiment of the present technique employing array elements comprised of nematic colloids suspended in fluid.

In an alternative embodiment, the array 86 may comprise nematic, or liquid crystal colloids 100 suspended in fluid 101, as depicted in FIG. 6. As with the previous embodiment, a grid of control lines is associated with the array 86 and provides signals which determine the transmittance of the suspension of colloids 100 at each coordinate of the array 86. The nematic colloids 100 are typically needle-shaped and are comprised of a material which can be controllably oriented in a magnetic or electrostatic field. The material may or may not be substantially opaque or reflective to X-rays. If the material is essentially transparent to X-rays, the colloid 100 is coated with a material, such as lead, which is not transparent to X-rays.

In operation, in the absence of an electrostatic field at a coordinate of the array 86, the colloids 100 are disordered and at no particular orientation relative to the radiation stream 16 and act to effectively attenuate the stream 16. Coordinates of the array 86, however, which are activated possess an electrostatic field which orders the colloids 100 in the vicinity of the activated coordinate such that they are substantially parallel to the radiation stream 16. The portion of the array 86 so ordered is substantially transparent to the radiation stream 16 and therefore does not substantially attenuate the stream.

In one embodiment, the strength of the electrostatic field at each coordinate location can be graded along a continuum such that the degree of colloid ordering is also continuous. In this manner, each element of the array 86 can be set at a desired degree of order such that a full range of attenuation values is available for each element. As with the previous embodiment, a stack of arrays 86 can be employed to provide a finer range of attenuation than may be possible with a single array 86.

Figure 7:
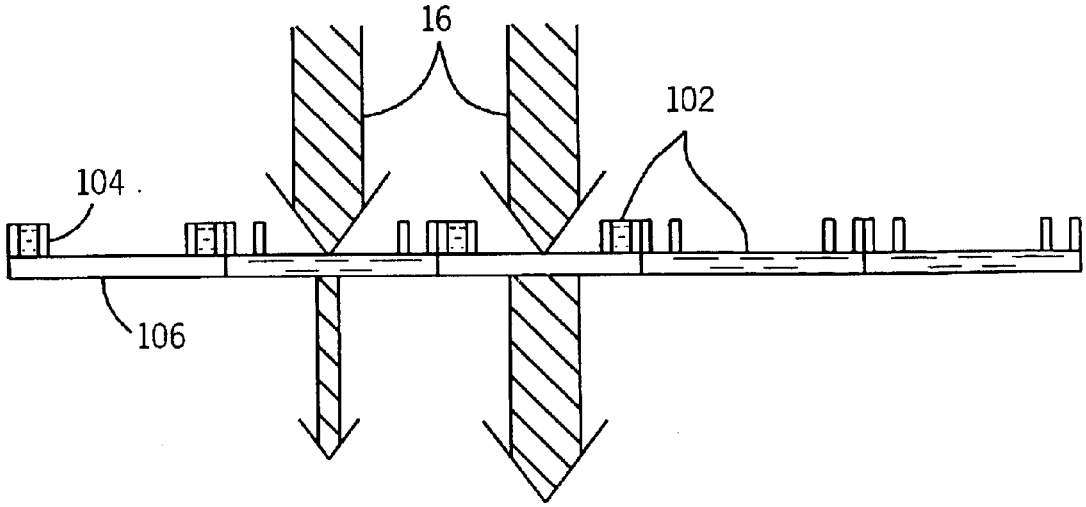
FIG. 7 is a diagrammatical side view of one embodiment of the present technique employing an array of fluid chambers filled by radiation-attenuating microfluidic devices.

In another embodiment, as depicted in FIG. 7, microfluidic control devices are employed to distribute an X-ray attenuating fluid 102 between storage reservoirs and an array 86 of attenuating chambers which possess different X-ray transmittance based upon their degree of filling. The microfluidic devices employed include, but are not limited to, microfluidic valves, fluid channels, such as tubing, electrode arrays (electrowetting), and peristaltic pumps. Selectively varying the fluid 102 level within the chambers thereby controls the attenuation of the radiation stream 16 through an element of the array 86. One embodiment of this technique is depicted in FIG. 7 and comprises attenuation chambers 106 oriented substantially perpendicular to the radiation stream 16, and reservoirs 104 oriented substantially parallel to the stream 16 which may be selectively filled with the fluid 102 such that the transmittance of each element is configurable. The X-ray attenuating fluid 102 can be a colloidal suspension of lead, or other attenuating material, particles, a ferrofluid, or various other fluids or fluidic suspensions which effectively attenuate X-rays of the X-ray stream 16.

Figure 8:
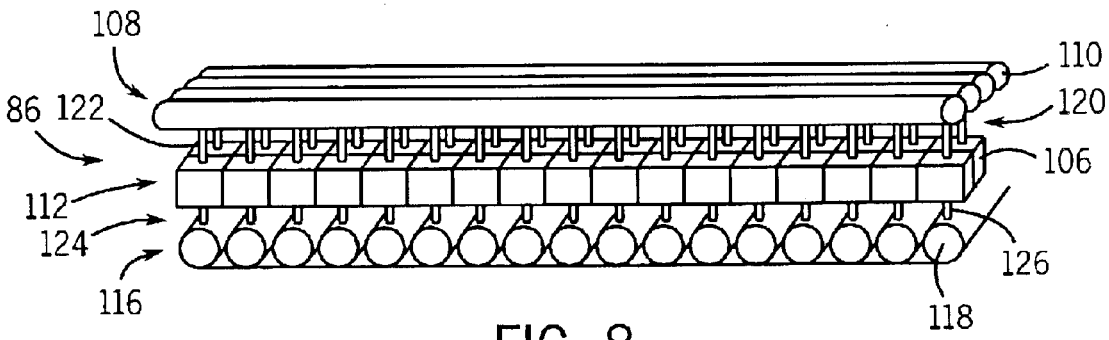
FIG. 8 is a partial perspective view of a cross-section of one alternative embodiment of the present technique employing an array of fluid filled chambers.

Another embodiment of this technique is depicted in FIG. 8 in perspective partial cross-section. In particular, a multilayer array 86 is depicted comprising various layers, including a supply layer 108 of supply tubing 110, a grid-like attenuation layer 112 of chambers 106 forming the elements of the array 86, and an evacuation layer 116 of evacuation tubing 118. A supply valve layer 120 consisting of microfluidic supply valves 122 interconnects the supply layer 108 and the attenuation layer 112 such that the interior spaces of the supply tubing 110 and the attenuation chambers 106 are in fluid communication. Similarly, an evacuation valve layer 124 consisting of microfluidic evacuation valves 126 interconnects the attenuation chambers 106 and the evacuation tubing 118 of their respective layers 112 and 116. The actuation of the individual valves 122, 126 is accomplished by various microfluidic control lines disposed within the respective supply 108 and evacuation 116.

The attenuation chambers 106 may be of various shapes such as columnar, cubic, hexagonal, rectangular, etc. and are arranged in array 86 such that space between the attenuation chambers 106 is minimized. The attenuation chambers 106 are composed of an X-ray transparent material that adheres well to the microfluidic devices and is structurally stable, such as silicone, carbon fiber, or glass. By controlling the level of the X-ray attenuating fluid in each cell, the attenuation of the X-ray stream 16 is spatially varied. For example, for regions of the patient anatomy or of the detector 22 for which X-ray flux is to be reduced, the respective attenuation chambers 106 are filled with the attenuating fluid 102 to a level corresponding to the desired degree of attenuation. Where little attenuation is desired, the attenuation chambers 106 are left empty or can be filled with a secondary fluid which has no or low attenuating properties. Due to the use of microfluidic control structures, each attenuation chamber 106, or element, within the array 86 is filled or emptied independently, thereby allowing the selective attenuation.

Figure 9:
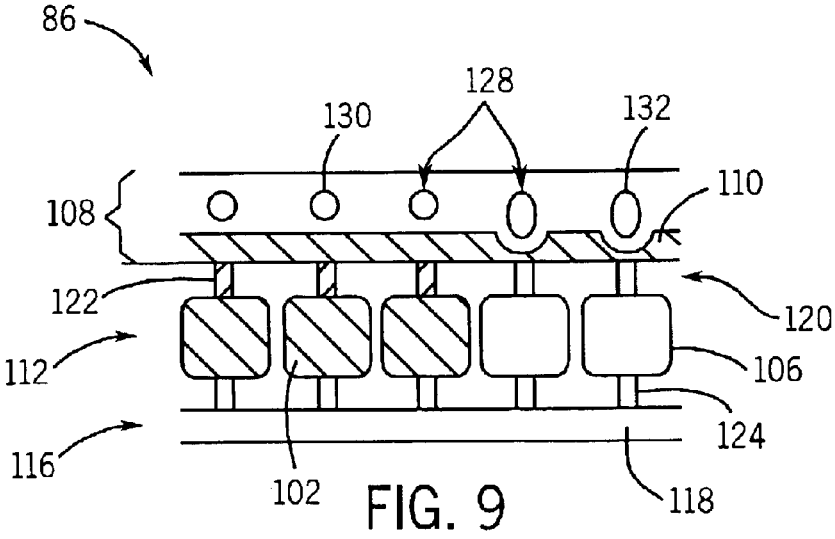
FIG. 9 is a cross-sectional view of another alternative embodiment of the present technique employing an array of fluid filled chambers.
Figure 10:
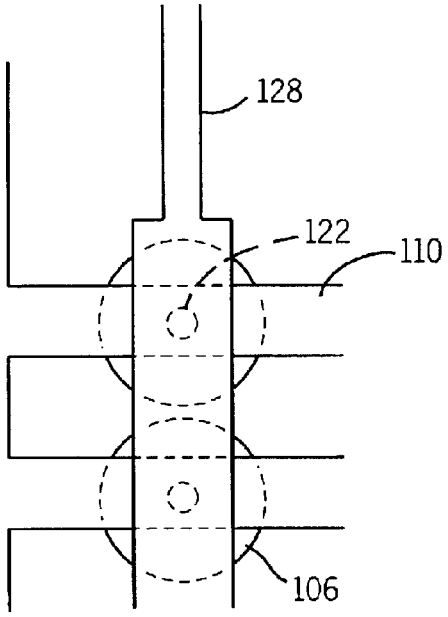
FIG. 10 is a plan view of the embodiment depicted in FIG. 9.
Figure 11:
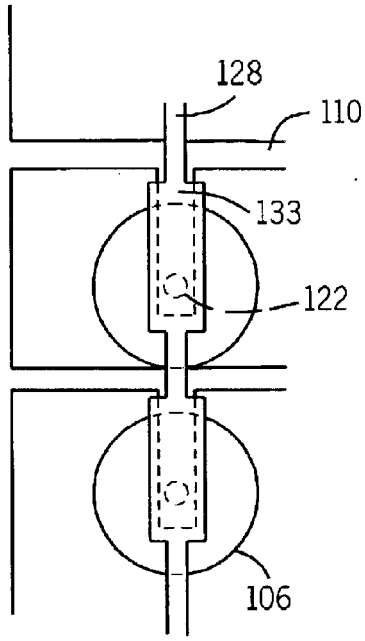
FIG. 11 is another plan view of the embodiment depicted in FIG. 9 incorporating an alternative valve configuration.

Further elaboration of this microfluidic technique is provided in FIGS. 9, 10, and 11 which depict cross-sectional and plan-view schematics of an exemplary device based upon flexible microfluidic "chips." In such embodiments, the level of attenuating fluid 102 in each attenuation chamber 106 is controlled from the edges of the array 86. As a result, the attenuation pattern for the array 86 is set in a series of column-filling steps such that the chambers 106 of one column of the array 86 are selectively filled before proceeding to the chambers 106 of another column of the array 86 until all columns of the array 86 are addressed. Different valve design implementations allow the rows to be set either in sequence or in random order.

In the embodiment depicted in FIGS. 9, 10 and 11, the supply layer 108 includes a layer of control lines 128 arranged perpendicularly above the supply lines 110. As discussed above, each supply line 110 is in fluid communication via a duct or valve 122 with the chambers 106 in the row beneath it. The control lines 128 may be pressurized with air or other fluids such that, when pressurized, the supply line 110 underneath is compressed at that location. This is illustrated in FIG. 9 where it can be seen that an unpressurized control line 130 does not compress the underlying supply line 110, while a pressurized control line 132 does compress the underlying supply line 110 at that point. When compressed, the supply line 110 covers the duct or valve 122 to the adjoining attenuation chamber 106, preventing the flow of attenuation fluid 102 into the chamber 106. In the embodiment depicted in FIG. 10, the supply line 110 is not displaced laterally relative to the chamber 106, and is directly compressed when control line 128 is pressurized, thereby closing the valve 122. This arrangement is best suited for filling the columns in order, such as from the far side of the array 86 to the near side, since no fluid 102 can flow past a previously filled column. In the embodiment of FIG. 11, the supply line 110 is displaced laterally relative to the chamber 106 and is connected to the chamber 106 by a connecting extension 133. Pressurization of the control line 128 controls the flow of fluid 102 through the connecting extension 133, but the fluid flow through the main supply line 110 is not affected, allowing more flexibility in the order of filling of the columns.

By properly varying which control lines 128 are pressurized, the flow of attenuating fluid 102, and thereby the X-ray transmittance, into each individual chamber 106 is controlled. In the embodiment depicted in FIG. 9, no evacuation valves are present at the bottom of the attenuation chambers 106. The attenuation fluid 102 is flushed from the entire array 86 with an X-ray transparent fluid between uses and then refilled to the desired, configurable level with attenuating fluid 102. The two fluids can then be separated for reuse outside of the array 86.

For example, in its initial state, the array 86 is filled with the X-ray transparent flush fluid. To fill a column of the array 86, the control line 128 associated with the column is not pressurized, and therefore remains an unpressurized control line 130, allowing the supply valves 122 connecting the supply lines 110 to the attenuation chambers 106 to remain open. The control lines 128 associated with all other columns are pressurized, however, to become pressurized control lines 132, thereby closing the supply valves 122 between the supply lines 110 and attenuation chambers 106 in those columns. Individual supply lines 110 are then pressurized with attenuating fluid 102 to fill the desired chambers 106 of the column being configured. After the desired fluid levels within the chambers 106 of the column are set, the control line 128 associated with the column is pressurized to become a pressurized control line 132, thereby locking in the fluid levels in that column. The process is then repeated, on a column-by-column basis, for the remaining columns of the array 86. A multiplexer can be used to control the pressure of both the supply lines 110 and the control lines 128. The number of control lines 128 and supply lines 110 is determined by the number of fluid chambers 106 in the array 86. In an exemplary embodiment, a multiplexer may use 2n control lines 128 to regulate 2" supply lines.

Figure 12:
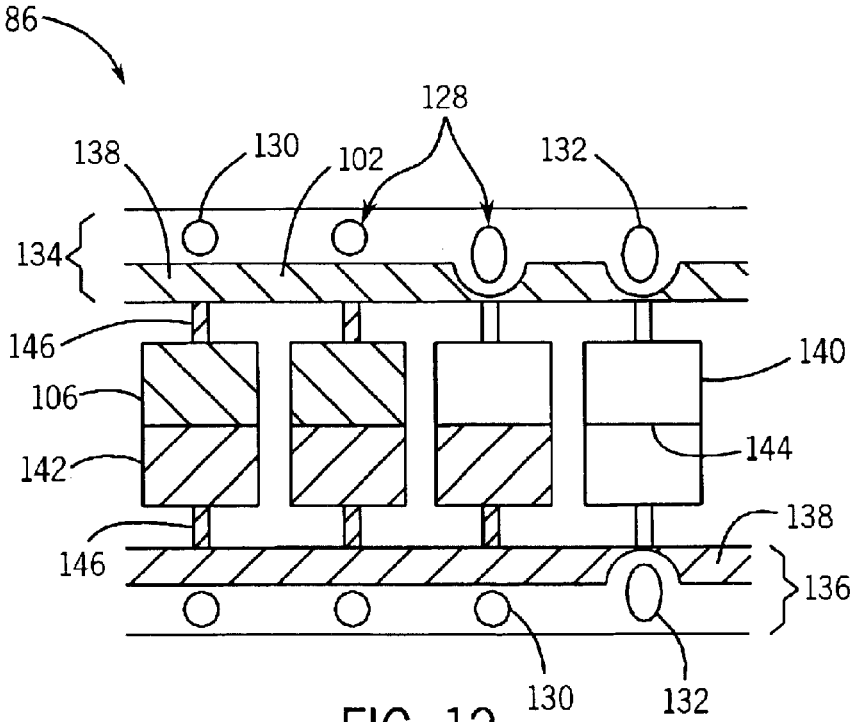
FIG. 12 is a cross-sectional view of another alternative embodiment of the present technique employing an array of radiation-attenuating fluid filled chambers.

While the embodiment disclosed in FIGS. 9, 10 and 11 is useful for creating an array 86 in which the elements are either high or low attenuation, i.e. filled or unfilled, it may be employed to provide few or no intermediate levels of attenuation within an array element. The embodiment of FIG. 12 provides for such intermediate levels of attenuation. In FIG. 12, separate upper and lower regulatory layers 134, 136 are employed which each provide separate fluid input and output functions to the attenuation chambers 106 via fluid lines 138. Both upper and lower regulatory layers 134 and 136 include control lines 128 which correspond to the columns of the array which are arranged perpendicular to and exterior to the fluid lines 138. The attenuation chambers 106 are divided into upper 140 and lower 142 chambers by an impermeable membrane 144, barrier, or other structure inside the chamber 106 which keeps the fluid contents of the upper 140 and lower 142 chambers from mixing.

Valves 146 fluidically connect the respective fluid lines 138 and upper 140 and lower 142 chambers of the attenuation chambers 106. The control lines 138, as in the prior embodiment, act to seal the valves 146 when pressurized 132 but do not seal the valves 146 when unpressurized, as discussed with respect to the prior embodiment. By controlling the fluid flow into and out of the upper 140 and lower 142 chambers by means of the separate valves 146, unwanted mixing of the fluids due to backwash may be prevented. In addition, no flush stage between settings is required and the fluid levels remain stable over a period of time.

As with the prior embodiment, the attenuation chambers 106 of the array 86 may be filled with an X-ray transparent flush fluid. The control lines 138 of the upper regulatory layer 134 are pressurized except for the control line 138 associated with the column to be filled closing the valves 146 on those columns not being filled. The control lines 138 of the lower regulatory layer remain unpressurized. Individual fluid lines 138 are then pressurized with attenuating fluid 102 to fill the attenuation chambers 106 of the column being configured. Due to the presence of the X-ray transparent fluid within the attenuation chambers 106 in other columns, the attenuating fluid does not traverse the lower regulatory layer 136 fluid lines 138 to fill those chambers 106. After the desired fluid levels are achieved within the chambers 106 of the selected column, the control line 128 associated with the column in the lower regulatory layer 136 is pressurized, thereby locking in the fluid levels in that column. The process is then repeated, on a column-by-column basis, for the remaining columns of the array 86. A multiplexer can be used to control the pressure of both the fluid lines 138 and the control lines 128.

Figure 13:
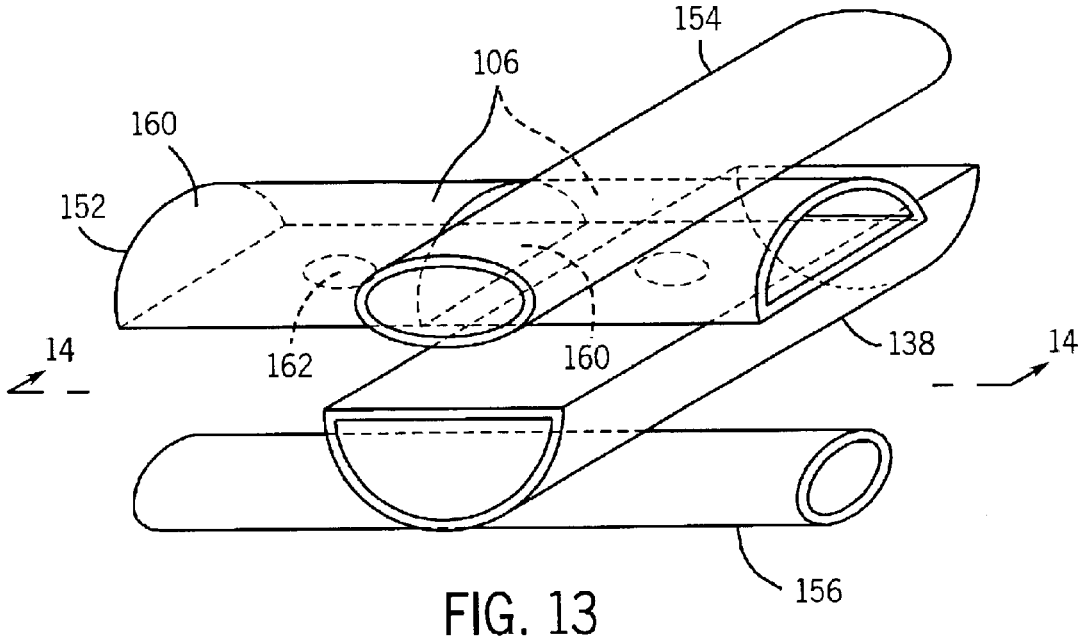
FIG. 13 is a perspective view of another alternative embodiment of the present technique employing an array of fluid filled chambers.
Figure 14:
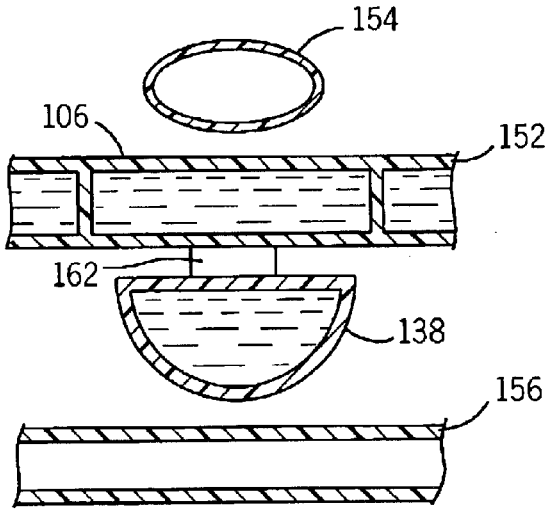
FIG. 14 is a cross-sectional view of the embodiment depicted in FIG. 13.

A third microfluidic embodiment is depicted in FIGS. 13 and 14, which utilizes rows of segmented fluid channels 152 as opposed to a separate layer of attenuation chambers. Each segmented fluid line 152 runs perpendicular to and above an open fluid line 138. A fill control line 154 is disposed perpendicular to and above each segmented fluid line 152 and a flow control line 156 is disposed perpendicular to and below each open fluid line 138. The segmented fluid line 152 is divided into distinct chambers 106 by impermeable walls 160. The open fluid line 138 supplies attenuating fluid 102 to the chambers 106 through a connecting duct 162. The fill control line 154 controls the availability of the underlying chambers 106 to the attenuating fluid 102. When fill control line 154 is pressurized, the fluid 102 is pushed out of the underlying chambers 106 or the duct 162 is blocked such that fluid 102 cannot enter the chambers 106, allowing chambers 106 to be selectively filled. The flow control line 156, which runs parallel to the segmented fluid line 152, is unpressurized during the filling or emptying of the chambers 106 along a row. Once a row of chambers 106 is properly configured for the desired attenuation, the flow control line 156 is pressurized, thereby closing the duct 162 to each chamber 106 in the row. The array 86 of chambers 106 is thereby configured and locked on a row-by-row basis. Afterwards, all flow control lines 156 may be unpressurized to unseal the cell ducts 162 and all fill control lines 154 may be pressurized to eject the attenuating fluid 102 from the chambers 106.

Figure 15:
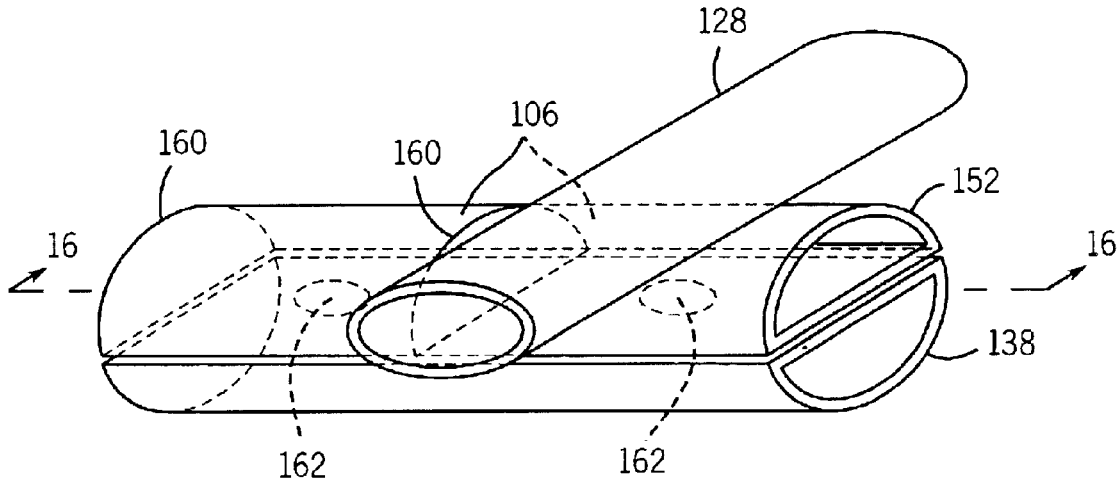
FIG. 15 is a perspective view of another alternative embodiment of the present technique employing an array of fluid filled chambers.
Figure 16:
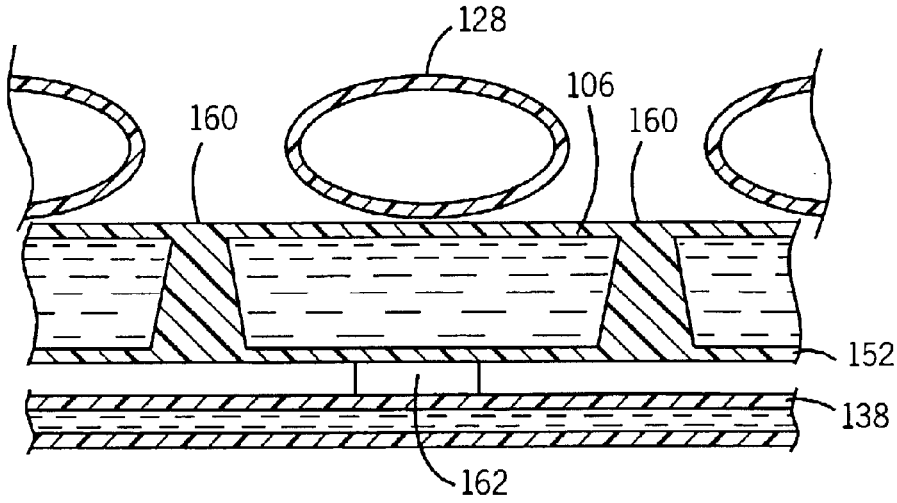
FIG. 16 is a cross-sectional view of the embodiment depicted in FIG. 15.

This embodiment may be further modified, as depicted in FIGS. 15 and 16, by providing segmented fluid lines 152 disposed above and parallel to the open fluid lines 138. The segmented fluid lines 152 are divided by impermeable walls 160 into chambers 106, each of which is in fluid communication with the underlying open fluid line 138 via a duct 162. A control line 128 is disposed perpendicular to and above the segmented fluid line 152.

Initially, the control lines 128 are pressurized to collapse the underlying chambers 106. The array 86 of chambers 106 is then filled in a row-by-row manner. To fill a row of chambers 106, the open fluid line 138 associated with that row is filled with attenuating fluid 102. The column control lines 128 associated with the chambers 106 to be filled are then unpressurized, allowing the selected chambers 106 in that row to fill with fluid 102. If desired, a control line 128 may maintain an intermediate level of pressure, thereby allowing only partial filling of a chamber 106 with the attenuating fluid 102. In this manner, a chamber 106 can be configured to provide intermediate levels of attenuation.

When the chambers 106 of the row are filled to their desired levels, the open fluid line 138 is flushed with an X-ray transparent fluid and the pressure on all control lines 128 is released, allowing any unfilled volume to fill with the transparent fluid. The open fluid line 138 remains pressurized with the transparent fluid while successive rows of chambers 106 are configured. Maintaining the pressure on the open fluid line 138 maintains the attenuation configuration for each row of chambers 106 while the control lines 128 fluctuate in pressure during the subsequent row filling operations. The array 86 of chambers 106 may subsequently be flushed by releasing the pressure on the open fluid lines 138 and pressurizing the control lines 128, forcing the fluid 102 out of the chambers 106.

While the invention may be susceptible to various modifications and alternative forms, specific embodiments have been shown by way of example in the drawings and have been described in detail herein. However, it should be understood that the invention is not intended to be limited to the particular forms disclosed. Rather, the invention is to cover all modifications, equivalents, and alternatives falling within the spirit and scope of the invention as defined by the following appended claims.

What is claimed is:

1. A method for selectively attenuating an X-ray radiation stream, comprising:

actuating two or more microactuators of an array of configurable and independently addressable microactuators; and passing a stream of X-ray radiation from an X-ray source through the array such that the stream is differentially attenuated by the two or more microactuators comprising an X-ray attenuating material.

2. The method as recited in claim 1, further comprising exposing a target to an unattenuated radiation stream to determine the desired attenuation level for each microactuator.

3. The method as recited in claim 1, wherein the two or more microactuators are actuated between an actuated state and an unactuated state, wherein the actuated state and the unactuated state attenuate the stream of radiation by different amounts.

4. The method as recited in claim 1, wherein a partially actuated microactuator intermediately attenuates the stream of radiation.

5. The method as recited in claim 1, further comprising configuring one or more additional arrays of configurable and independently addressable microactuators to complement the array such that the stream is selectively attenuated.

6. The method as recited in claim 1, wherein the each microactuator is configured to be actuated between a high attenuation state and a low attenuation state.

7. A selective attenuation system for an X-ray radiation stream, comprising:

a source of an X-ray radiation stream;

a detector of the radiation stream; and a configurable collimator positioned between the source and the detector, comprising at least one array of independently configurable attenuating microactuators comprising an X-ray attenuating material.

8. The selective attenuation system as recited in claim 7, wherein the source is an X-ray tube.

9. The selective attenuation system as recited in claim 7, wherein the configurable collimator comprises a stack of arrays of independently configurable attenuating microactuators.

10. The selective attenuation system as recited in claim 7, wherein the attenuating microactuators are configurable to at least one of a closed and an open state.

11. The selective attenuation system as recited in claim 7, wherein the attenuating material comprises at least one of lead, tungsten, and molybdenum.

12. A method for selectively attenuating an X-ray radiation stream, comprising:

configuring two or more elements of an array configurable and independently addressable elements by selectively imposing an ordered state upon a plurality of X-ray attenuating colloids suspended in a fluid within each element; and passing a stream of X-ray radiation from a source through the array such that the stream is differentially attenuated by the two or more elements.

13. The method as recited in claim 12, wherein selectively imposing an ordered state comprises selectively applying at least one of a magnetic field or an electric field to each element to control the ordered state of the plurality of attenuating colloids within each respective element.

14. The method as recited in claim 12, wherein imposing an ordered state upon the plurality of attenuating colloids of an element produces a low attenuation element.

15. The method as recited in claim 12, wherein configuring the two or more elements comprises selectively applying at least one of a weak electric field or a weak magnetic field to each element to be set to an intermediate attenuation state.

16. The method as recited in claim 12, further comprising exposing a target to an unattenuated radiation stream to determine the desired attenuation level for each element.

17. The method as recited in claim 12, further comprising configuring one or more additional arrays of configurable and independently addressable elements to complement the array such that the stream is selectively attenuated.

18. A method for selectively attenuating an X-ray radiation stream, comprising:

differentially filling, using one or more microfluidic devices, two or more non-capillary fluid chambers of an array of configurable and independently addressable non-capillary fluid chambers with an X-ray attenuating fluid; and passing a stream of X-ray radiation on from a source through the array such that the stream is differentially attenuated by the two or more non-capillary fluid chambers.

19. The method as recited in claim 18, wherein differentially filling a respective fluid chamber comprises controlling a valve providing access to the respective fluid chamber by controlling the pressure within a control line associated with the respective fluid chamber.

20. The method as recited in claim 18, wherein a respective fluid chamber substantially full of the attenuating fluid corresponds to a high attenuation state while the respective fluid chamber substantially empty of the attenuating fluid corresponds to a low attenuation state.

21. The method as recited in claim 18, wherein a respective fluid chamber partially full of the attenuating fluid corresponds to an intermediate attenuation state.

22. The method as recited in claim 18, wherein differentially filling a respective fluid chamber comprises controlling the supply of the attenuating fluid within a fluid line associated with the respective fluid chamber.

23. The method as recited in claim 18, further comprising exposing a target to an unattenuated radiation stream to determine the desired attenuation level for each non-capillary fluid chamber.

24. The method as recited in claim 18, further comprising configuring one or more additional arrays of configurable and independently addressable non-capillary fluid chambers to complement the array such that the stream is selectively attenuated.

25. A selective attenuation system for an X-ray radiation stream, comprising:

a source of an X-ray radiation stream;

a detector of the radiation stream; and a configurable collimator positioned between the source and the detector, comprising at least one array of independently configurable X-ray attenuating elements, wherein each element comprises a respective non-capillary fluid chamber configured to be differentially filling, using one or more microfluidic devices, with an X-ray attenuating fluid supplied to the respective non-capillary fluid chamber by a fluid line.

26. The selective attenuation system as recited in claim 25, further comprising control lines which control the filling and emptying of each non-capillary fluid chamber.

27. The selective attenuation system as recited in claim 26, wherein a respective control line, when pressurized, seals a valve of a respective non-capillary fluid chamber, thereby preventing the respective non-capillary fluid chamber from filling with the attenuating fluid.

28. The selective attenuation system as recited in claim 26, wherein a respective control line, when pressurized, seals a valve of a respective non-capillary fluid chamber, thereby preventing the respective non-capillary fluid chamber from emptying of the attenuating fluid.

29. A selective attenuation system for an X-ray radiation stream, comprising:

a source of an X-ray radiation stream;

a detector of the radiation stream; and a configurable collimator positioned between the source and the detector, wherein the configurable collimator comprises at least one array of independently configurable X-ray attenuating elements, each element comprising a plurality of X-ray attenuating nematic colloids suspended within a fluid.

30. The selective attenuation system as recited in claim 29, further comprising a field generator capable of applying at least one of a magnetic field or an electric field to a respective element of the array such that the plurality of nematic colloids within the respective element are ordered parallel to the radiation stream.

31. The selective attenuation system as recited in claim 29, wherein the configurable collimator comprises a stack of arrays of independently configurable attenuating elements, each element comprising a plurality of nematic colloids suspended within a fluid.

32. The selective attenuation system as recited in claim 29, wherein the source is an X-ray tube.

* * * * *